US008383012B2

(12) United States Patent
Galletti

(10) Patent No.: US 8,383,012 B2
(45) Date of Patent: Feb. 26, 2013

(54) ELECTRIC ARTICLE COMPRISING AT LEAST ONE ELEMENT MADE FROM A SEMICONDUCTIVE POLYMERIC MATERIAL AND SEMICONDUCTIVE POLYMERIC COMPOSITION

(75) Inventor: Franco Galletti, Milan (IT)

(73) Assignee: Prysmian S.p.A., Milan (IT)

( * ) Notice: Subject to any disclaimer, the term of this patent is extended or adjusted under 35 U.S.C. 154(b) by 337 days.

(21) Appl. No.: 12/747,495

(22) PCT Filed: Dec. 14, 2007

(86) PCT No.: PCT/IB2007/004001

§ 371 (c)(1),
(2), (4) Date: Sep. 24, 2010

(87) PCT Pub. No.: WO2009/077804

PCT Pub. Date: Jun. 25, 2009

(65) Prior Publication Data

US 2011/0017509 A1 Jan. 27, 2011

(51) Int. Cl.
*H01B 1/06* (2006.01)
*H01B 3/30* (2006.01)

(52) U.S. Cl. ..... 252/511; 174/110 SR

(58) Field of Classification Search ..... 252/511; 174/110 SR

See application file for complete search history.

(56) References Cited

U.S. PATENT DOCUMENTS

| | | | | |
|---|---|---|---|---|
| 4,585,578 | A | 4/1986 | Yonahara et al. | |
| 5,476,612 | A | 12/1995 | Wessling et al. | |
| 5,733,480 | A | 3/1998 | Lee et al. | |
| 6,441,084 | B1 | 8/2002 | Lee et al. | |
| 7,008,991 | B2 * | 3/2006 | Takagi et al. | 524/496 |
| 2004/0119056 | A1 * | 6/2004 | Hofmann et al. | 252/500 |
| 2007/0007495 | A1 | 1/2007 | Hayes | |
| 2010/0234514 | A1 * | 9/2010 | Noguchi et al. | 524/496 |

FOREIGN PATENT DOCUMENTS

| | | |
|---|---|---|
| EP | 0 600 354 A2 | 6/1994 |
| EP | 1 052 654 A1 | 11/2000 |
| JP | 60-42461 | 3/1985 |
| WO | WO-98/52197 | 11/1998 |

OTHER PUBLICATIONS

International Search Report from the European Patent Office for International Application No. PCT/IB2007/004001 (Mail date Sep. 3, 2008).

* cited by examiner

*Primary Examiner* — Mark Kopec
*Assistant Examiner* — Jaison Thomas
(74) *Attorney, Agent, or Firm* — Finnegan, Henderson, Farabow, Garrett & Dunner, L.L.P.

(57) ABSTRACT

An electric article, particularly an electric cable or an accessory thereof, such as a cable joint or a cable termination, includes at least one element made from a semiconductive polymeric material, wherein the at least one element is obtained by crosslinking a semiconductive polymeric composition including: (a) at least one elastomeric polymer; (b) a filler mixture including: (i) at least one first carbon black having a dibutyl phthalate (DBP) absorption number of from 250 to 600 ml/100 g; (ii) at least one second carbon black, different from the first one, having a dibutyl phthalate (DBP) absorption number of from 80 to 250 ml/100 g; and (c) at least one graphite having a specific surface area, measured according to the BET method, not higher than 20 $m^2/g$.

41 Claims, 2 Drawing Sheets

ELECTRIC ARTICLE COMPRISING AT LEAST ONE ELEMENT MADE FROM A SEMICONDUCTIVE POLYMERIC MATERIAL AND SEMICONDUCTIVE POLYMERIC COMPOSITION

CROSS REFERENCE TO RELATED APPLICATION

This application is a national phase application based on PCT/IB2007/004001, filed Dec. 14, 2007, the content of which is incorporated herein by reference.

BACKGROUND OF THE INVENTION

The present invention relates to an electric article, particularly to an electric cable or an accessory thereof, such as a cable joint or a cable termination, comprising at least one element made from a semiconductive polymeric material, and to a semiconductive polymeric composition.

Electric cables, particularly electric cables for medium or high voltage, usually comprise at least one electric conductor, at least one insulating layer and at least one semiconductive layer. Particularly, a first semiconductive layer is usually placed between the electric conductor and the insulating layer, while a second semiconductive layer is applied in contact with the external surface of the insulating layer. In some applications, the cable is further equipped with at least one metallic shield placed in a radially external position with respect to the second semiconductive layer. The semiconductive layers operate to provide uniform electric field around the cable insulation by reducing the potential gradient over the surface of the stranded conductors and inside the metal shielding, and to prevent corona discharge at the surfaces of the stranded conductors and the insulation. Moreover, the semiconductive layers should protect the cable against damage caused by conductors heating due to short-circuited current.

Elements made from semiconductive polymeric materials are also used in electric cable accessories, particularly in cable joints and cable terminations, where it is essential, in order to prevent electric breakdown, to provide the accessories with such elements placed in correspondence with the zones where cable insulating and/or semiconductive layers are interrupted so as to avoid excessive concentrations of flux lines of the electric field.

Elements, and particularly layers, made from semiconductive polymeric materials are usually produced by extrusion of polymeric compositions containing at least one carbon black as electrically conductive filler. The conductivity of carbon blacks is generally correlated to their morphological structure, which can be characterized by different experimental parameters, particularly by specific surface area, measured according to the BET (Brunauer, Emmett and Teller) method, and porosity, measured by means of dibutyl phthalate (DBP) oil absorption. Usually carbon blacks having high values of BET surface area and high DBP absorption values have high conductivity values and are said to be "highly structured". See, for example, U.S. Pat. No. 5,733,480, U.S. Pat. No. 5,476,612 and U.S. Pat. No. 6,441,984.

It is widely felt the need to increase the conductivity of polymeric materials so as to produce semiconductive elements for electric articles as described above having increased effectiveness and/or reduced thickness.

For instance, U.S. Pat. No. 4,585,578 relates to an electrically conductive plastic complex material containing as essential constituents 30 to 80 wt. percent of base plastic complex material (component A), 5 to 40 wt. percent of electrically conductive carbon black (component B) and 5 to 65 wt. percent of graphite as inorganic filler (component C), related to the total contents of the essential components. The plastic complex material may include different polymeric products, such as, inter alia, thermosetting resins, thermoplastic resins such as polyolefins, polystyrene, silicon rubbers such as SBR, butadiene rubber, polyisoprene, EP rubber, NBR or polyurethane rubbers. Preferably, the electrically conductive carbon black has a particle size in the range of 30 to 46 nm, a surface area in the range of 245 to 1000 $m^2/g$, DBP oil absorption in the range of 160 to 340 ml/100 g. As component C, graphite can be used as it is or it may be doped for further improving electric conductivity of the conductive plastic complex material. The above compositions are said to have high electric conductivity and mechanical strength, and also a volume resistivity which is not affected by variation of temperature.

U.S. Pat. No. 5,476,612 relates to a method for preparing polymeric compositions rendered antistatic or electrically conductive by incorporating into a non-conductive matrix polymer a combination of: (A) a first finely divided conductive material, namely conductive carbon black with a BET surface area of more than 80 $m^2/g$ or an intrinsically conductive organic polymer in complexed form; and (B) a second finely divided conductive material, namely graphite or an intrinsically conductive polymer in complexed form, which is different from the material used as material A, or a metal powder; and/or (C) a finely divided non conductive material having an average particle size below 50 μm. At a given additive content in the polymer matrix the conductivity of the compound is significantly increased if a finely divided (preferred average particle size≦1 μm) conductive material A is combined with another conductive material B consisting preferably of larger particles of >0.5 μm, e.g. about 10 μm (1 to 50 μm), and/or a non-conductive material C having an average particle size <10 microns. Graphites are suitable as material B. Particularly preferred is intercalated graphite, e.g. graphite loaded with copper(III)-chloride or with nickel(III)-chloride. Further electrode graphite or natural graphite may be used. Metal are also useful as material B. As material C essentially all pigments, fillers and other non-conductive particulate materials which are non-fusible under processing conditions or materials which are insoluble in the polymer matrix and having an average particle size of about 50 microns or less may be used.

U.S. Pat. No. 5,733,480 relates to semiconductive polyolefin compositions comprised of: (a) 85 to 94 weight percent polyethylene having a density of 0.910 to 0.935 $g/cm^3$ and melt index of 2 to 15 g/10 min; and (b) 6 to 15 weight percent of a carbon black mixture consisting essentially of: (i) 10 to 90 percent highly conductive carbon black having a particle size of 10 to 50 nm, BET surface area greater than 500 $m^2/g$, DBP adsorption number of 200 to 600 ml/100 g and volatiles content of 2% or less; and (ii) 90 to 10 percent conductive carbon black having a particle size of 10 to 50 nm, BET surface area of 125 to 500 $m^2/g$, DBP adsorption number of 80 to 250 ml/100 g and volatiles content of 2% or less. The above compositions are said to be readily processable so as to be extruded into films and coatings having high conductivity, good opacity and good surface quality. Furthermore, in view of the ability to use carbon black levels of 15 percent and below, the resulting films and coatings also exhibit good flexibility and mechanical properties. The above balance of properties and processability is achieved through the use of a combination of two conductive blacks of differing structure.

U.S. Pat. No. 6,441,084 relates to LLDPE (linear low density polyethylene) semi-conductive compositions having improved processability and extrudability for wire and cable applications. The semi-conductive extrusion compositions comprise: (a) 75 to 95 weight percent, based on the total weight of the composition, of a base resin comprising linear low density polyethylene having a density from 0.890 to 0.925 g/cm$^3$ and melt index from 0.3 to 15 g/10 min; and (b) 5 to 25 weight percent, based on the total weight of the composition, of a carbon black mixture containing a major portion of a higher structure conductive carbon black and a minor proportion of a lower structure conductive carbon black. Preferably, the higher structure black has a BET surface area greater than 500 m$^2$/g and dibutyl phthalate absorption number from 200 to 600 ml/g and the lower structure black has a BET surface area of 125 to 500 m$^2$/g and dibutyl phthalate absorption number of 80 to 250 ml/g.

U.S. Patent Application No. 2007/0007495 relates to a composition comprising carbon black-containing polyetherester, which comprises ≦about 3.5 weight % of carbon blacks having a DBP (dibutyl phthalate oil adsorption)>about 420 cc/100 g. The composition can comprise about ≦15 weight % of carbon blacks having a DBP between about 220 cc/100 g and about 420 cc/100 g. The composition can also comprise ≦ about 15 weight % of carbon blacks having a DBP between about 150 cc/100 g and about 210 cc/100 g. The reduced level of carbon blacks in the above polyetherester compositions is said to achieve the desired electric properties without unduly deteriorating the other valued melt viscosity, processing and shaped article properties.

The composition or polyetherester may be filled with about 1 to about 40 weight % of various inorganic, organic and clay fillers, which include, inter alia, graphite fibers. Such filler may improve the toughness of the composition, increase the Young's modulus, improve the dead-fold properties, improve the rigidity of the film, coating, laminate, or molded article, decrease the cost, and reduce the tendency of the film, coating, or laminate to block or self-adhere during processing or use. The carbon-black containing polyetherester can be coated or laminated onto a substrate. The coated substrates may have a variety of uses including, inter alia, semiconductive cable jacket.

EP Patent Application No. 1 052 654 A1 relates to an electric power cable having a semiconducting shield. The cable comprises one or more electric conductors, each electric conductor being surrounded by a layer comprising: (a) polyethylene; polypropylene; or mixtures thereof; (b) carbon nanotubes; (c) optionally, a conductive carbon black other than carbon nanotubes; and (d) optionally, a copolymer of acrylonitrile and butadiene, wherein the acrylonitrile is present in an amount of about 30 to about 60 percent by weight based on the weight of the copolymer or a silicone rubber. The carbon nanotubes are made of carbon and are high strength sub-micron sized fibril particles having a graphitic morphological structure and configuration. A typical carbon nanotube can be described as a tube made up of eight layers of rolled-up graphite sheets having a hollow core 0.0005 micron in diameter and an outer diameter of 0.01 micron (100 Angstroms). Their BET surface area is of about 250 m$^2$/g; and the DBP absorption is 450 cc/100 g. When the carbon nanotubes are essentially the only carbon in the semiconducting layer composition, they can be used in amounts of about 1 to about 35 parts by weight per 100 parts by weight of component (a). When they are used together with another conductive carbon black, the weight ratio of carbon nanotubes to conductive carbon black can be about 0.1:1 to about 10:1, and the total of carbon nanotubes and other conductive carbon black can be in the range of about 5 to about 80 parts by weight per 100 parts by weight of component (a). Component (c) is optional, and can be a conventional conductive carbon black commonly used in semiconducting shields (the grades described by ASTM N550, N472, N351, N110, Ketjen blacks, and acetylene blacks). Where the carbon is essentially carbon nanotubes, interface roughness between the insulation and the semiconducting shield is said to be eliminated and the cleanliness of the semiconducting shield is said to be increased.

SUMMARY OF THE INVENTION

The Applicant has faced the problem of providing electric articles, particularly electric cables or accessories thereof, including at least one element made from a semiconductive polymeric material having increased conductivity while maintaining satisfactory mechanical properties by using at least one elastomeric polymer filled with at least one highly structured carbon black.

In this respect, the Applicant has found out that the solutions suggested in the art for increasing processability of thermoplastic semiconductive compositions based on polyolefins, such as LLDPE, by using mixtures of carbon blacks having different structures and thus different conductivities (see e.g. the above discussed U.S. Pat. Nos. 5,733,480 and 6,441,084) give unsatisfactory results when the semiconductive compositions are based on elastomeric polymers, whose viscosity dramatically increases when the amount of highly structured carbon blacks is increased. This results in a reduced processability so as to make difficult or even impossible to extrude semiconductive elements, particularly in the form of thin layers, with the desired uniformity. The presence of defects and irregularities inevitably impairs electric and mechanical properties.

In an attempt to solve the above problems, the Applicant tried to improve processability of the above compositions by adding and/or increasing the amount of processing aids normally used to process elastomeric compositions, such as paraffinic or aromatic oils. However, the results were totally unsatisfactory since the increased amount of oils caused an impairment of the mechanical properties and of the conductivity in the resulting article.

The Applicant has now found that it is possible to produce electric articles comprising at least one element made from a semiconductive polymeric material having improved electric performance and satisfactory mechanical properties by processing a semiconductive composition as defined hereinunder, which comprises at least one elastomeric polymer and at least one filler mixture dispersed therein, said at least one filler mixture comprising at least one carbon black having high conductivity, at least one carbon black having low-medium conductivity and at least one graphite having a low surface area.

Therefore, according to a first aspect, the present invention relates to an electric article comprising at least one element made from a semiconductive polymeric material, wherein said at least one element is obtained by crosslinking a semiconductive polymeric composition comprising:

(a) at least one elastomeric polymer;

(b) a filler mixture comprising: (i) at least one first carbon black having a dibutyl phthalate (DBP) absorption number of from 250 to 600 ml/100 g; (ii) at least one second carbon black, different from the first one, having a dibutyl phthalate (DBP) absorption number of from 80 to 250 ml/100 g; and (c) at least one graphite having a specific surface area, measured according to the BET method, not higher than 20 m$^2$/g.

According to a preferred embodiment, the electric article is an electric cable.

According to another preferred embodiment, the electric article is an electric cable joint.

According to another preferred embodiment, the electric article is an electric cable termination.

According to a second aspect, the present invention relates to a semiconductive polymeric composition comprising:

(a) at least one elastomeric polymer;

(b) a filler mixture comprising: (i) at least one first carbon black having a dibutyl phthalate (DBP) absorption number of from 250 to 600 ml/100 g; (ii) at least one second carbon black, different from the first one, having a dibutyl phthalate (DBP) absorption number of from 80 to 250 ml/100 g; and (c) at least one graphite having a specific surface area, measured according to the BET method, not higher than 20 $m^2/g$.

For the purpose of the present description and of the claims that follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

According to a preferred embodiment, the semiconductive polymeric composition according to the present invention comprises from 25 to 250 phr, preferably from 60 to 150 phr, of the filler mixture.

For the purposes of the present description and of the claims, the term "phr" means the parts by weight of a given component (or mixture of components) of the polymeric composition per 100 parts by weight of the elastomeric polymer(s).

Preferably, the filler mixture comprises: (i) from 10 to 80% by weight, preferably from 25 to 70% by weight, of the at least one first carbon black; (ii) from 20 to 90% by weight, preferably from 30 to 75% by weight, of the at least one second carbon black, the percentages by weight being expressed with respect to the total weight of the filler mixture.

According to a preferred embodiment, the semiconductive polymeric composition according to the present invention comprises from 0.5 to 70 phr, preferably from 2 to 40 phr, of the at least one graphite having a specific surface area not higher than 20 $m^2/g$.

In the present description and in the subsequent claims, as "elastomeric polymer" it is meant a homopolymer or copolymer of substantially amorphous structure which achieves the desired elastic properties when crosslinked. According to the chemical nature of the elastomeric polymer crosslinking may be carried out by different means, such as by radical reaction (e.g. by organic peroxides), by a sulphur vulcanizing system, or also by irradiation.

Preferably, the at least one elastomeric polymer of the present invention may be selected from:

(i) diene elastomeric polymers, generally having a glass transition temperature (Tg) below 20° C., preferably in the range of from 0° C. to −90° C.;

(ii) chlorinated or chlorosulphonated polyethylenes;

(iii) elastomeric copolymers of at least one mono-olefin with at least one olefinic comonomer or a derivative thereof;

(iv) polyester rubbers;

(v) polyurethane rubbers.

As regards the diene elastomeric polymers (i), they may be of natural origin or may be obtained by solution polymerization, emulsion polymerization or gas-phase polymerization of at least one conjugated diolefin, optionally in admixture with at least one comonomer selected from monovinylarenes and/or polar comonomers in an amount of not more than 60% by weight.

The conjugated diolefin generally contains from 4 to 12, preferably from 4 to 8, carbon atoms, and optionally may contain at least one halogen atom, preferably chlorine or bromine. It may be selected preferably from the group comprising: 1,3-butadiene, isoprene, 2-chloro-1,3-butadiene, 2,3-dimethyl-1,3-butadiene, 1,3-pentadiene, 1,3-hexadiene, 3-butyl-1,3-octadiene, 2-phenyl-1,3-butadiene, or mixtures thereof. 1,3-butadiene, 2-chloro-1,3-butadiene and isoprene are particularly preferred.

Monovinylarenes which may be optionally used as comonomers generally contain from 8 to 20, preferably from 8 to 12, carbon atoms, and may be preferably selected from: styrene, 1-vinylnaphthalene, α-methylstyrene, 3-methylstyrene, 4 propylstyrene, 4-p-tolylstyrene, or mixtures thereof. Styrene is particularly preferred.

Polar comonomers may be preferably selected from: vinylpyridine, vinylquinoline, acrylic acid and alkylacrylic acid esters, nitriles or mixtures thereof, such as, for example, methyl acrylate, ethyl acrylate, methyl methacrylate, ethyl methacrylate, acrylonitrile, or mixtures thereof.

Preferably, the diene elastomeric polymer (i) may be selected from: cis-1,4-polyisoprene (natural or synthetic, preferably natural rubber), 3,4-polyisoprene, polybutadiene, polychloroprene, optionally halogenated isoprene/isobutene copolymers, 1,3-butadiene/acrilonitrile copolymers (NBR), styrene/1,3-butadiene copolymers (SBR), styrene/isoprene/1,3-butadiene copolymers, styrene/1,3-butadiene/acrylonitrile copolymers, or mixtures thereof. Particularly preferred are 1,3-butadiene/acrilonitrile copolymers (NBR), available e.g. under the trade name Krynac™ by Lanxess Deutschland GmbH.

As regards the chlorinated or chlorosulphonated polyethylenes (ii), they may obtained by chlorination or chlorosulphonation of polyethylene.

Chlorination of polyethylene is generally carried out by radical reaction of polyethylene with chlorine activated by means of UV radiation or by peroxides. Chlorine content in the final polymer is generally from 25% to 45% by weight. Commercial grades are available, e.g., under the tradename Tyrin™ by The Dow Chemical Co.

Chlorosulphonation of polyethylene is generally carried out by dissolving polyethylene in a chlorinated solvent and saturating said solution with chlorine and sulphur dioxide under UV radiation. Chlorine content in the final polymer is generally from 20% to 45% by weight, while sulphur content is generally from 0.8 to 2% by weight. Commercially grades are available, e.g., under the tradename Hypalon™ by Du Pont Performance Elastomers LLC.

As regards the elastomeric copolymers (iii), they may be obtained by copolymerization of at least one mono-olefin with at least one olefinic comonomer or a derivative thereof. The monoolefins may be selected from: ethylene and α-olefins generally containing from 3 to 12 carbon atoms, such as: propylene, 1-butene, 1-pentene, 1-hexene, 1-octene, or mixtures thereof. The following are preferred: copolymers of ethylene with an α-olefin, and optionally with a diene; isobutene homopolymers or copolymers thereof with small amounts of a diene, which are optionally at least partially halogenated. The diene optionally present generally contains from 4 to 20 carbon atoms and is preferably selected from: 1,3-butadiene, isoprene, 1,4-hexadiene, 1,4-cyclohexadiene, 5-ethylidene-2-norbornene, 5-methylene-2-norbornene, vinylnorbornene, or mixtures thereof. Particularly preferred are: ethylene/propylene copolymers (EPR), ethylene/propylene/diene terpolymers (EPDM), polyisobutene, butyl rubbers, halobutyl rubbers, in particular chlorobutyl or bromobutyl rubber; or mixtures thereof. Preferably, the EPR/EPDM rubbers have the following monomer composition: 55-80% by weight, preferably 65-75% by weight, of ethylene; 20-45% by weight, preferably 25-35% by weight, of propylene; 0-10% by weight, preferably 0-5% by weight, of a diene (preferably 5-ethylene-2-norbornene).

The first carbon black (i) has a DBP absorption number of from 250 to 600 ml/100 g, preferably from 300 to 500 ml/100 g Preferably the first carbon black (i) has a BET specific surface area greater than 500 $m^2/g$, preferably from 600 to 2,000 $m^2/g$ The second carbon black (ii) has a DBP absorption number of from 80 to 250 ml/100 g, preferably from 100 to 200 ml/100 g.

Preferably the second carbon black (ii) has a BET specific surface area of from 20 to 400 $m^2/g$, preferably from 30 to 200 $m^2/g$ The DBP absorption number is measured according to standard ASTM D2414-01, while the BET specific surface area is measured according to standard ASTM D 4820.

Carbon blacks of the above types are known and available from commercial sources. For instance, the first carbon black (having high structure) may be selected from the products commercialized by Akzo Nobel under the tradename Ketjenblack™, such as the grades EC-300 J and EC-600JD.

As to the second carbon black, having medium-low structure, it can be selected from commercial grades known as N 550 and N 330 sold by Konimpex Ltd., or also from commercial grades sold by Timcal Ltd. under the tradename Ensaco™, e.g. the grade 250 G.

A graphite suitable for the present invention has a BET specific surface area not higher than 20 $m^2/g$, preferably not higher than 15 $m^2/g$. It may be of natural or synthetic origin and may be in the form of crystalline, flat, plate-like particles. Alternatively, the graphite may be amorphous in the form of fine particles. Synthetic graphite is generally a mixture of crystalline graphite and cross-linking intercrystalline carbon.

According to a preferred embodiment, a graphite suitable for the present invention has a particle size distribution with a d50 value of at least 3 μm, preferably from 5 to 25 μm. More preferably, a graphite suitable for the present invention has a particle size distribution with a d90 value of at least 10 μm, preferably from 15 to 50 μm. Particle size distribution may be determined by laser light scattering using Malvern technique. The d50 and d90 values correspond to a cumulative amount of particles equal to 50% by weight and 90% by weight of the total amount having a particle size not higher than d50 and not higher than d90 respectively.

It should be noted that in the semiconductive polymeric compositions according to the present invention, the graphite has a remarkable effect in reducing viscosity and thus in improving processability of the compositions themselves without having any negative impact on the conductivity, which remains substantially unchanged when adding graphite to the semiconductive composition. This allows to increase the amount of the added carbon blacks, especially of the highly structured carbon black, so as to increase conductivity while maintaining good processability.

The semiconductive polymeric compositions according to the present invention may also comprise other components. For instance, in order to crosslink the elastomeric polymer, at least one crosslinking agent may be added.

Preferably, crosslinking of the elastomeric polymer may be carried out by radical reaction, namely by thermal decomposition of at least one radical initiator, usually selected from organic peroxides, such as, for example, dicumyl peroxide, t-butyl cumyl peroxide, bis(terbutylperoxyisopropyl)benzene, bis(terbutylperoxy)2,5 dimethyl hexane, bis(terbutylperoxy)2,5 dimethyl hexyne 2,4-dimethyl-2,5-di(t-butylperoxy) hexane, di-t-butyl peroxide.

Besides the at least one radical initiator, at least one crosslinking coagent may be added, such as: triallyl-cyanurate, triallyl-isocyanurate, acrylates or diacrylates, polybutadiene having a high content of terminal vinyl groups, and mixtures thereof.

Alternatively, crosslinking may be achieved by adding a sulphur-based vulcanizing system according to well known techniques. The sulphur-based vulcanizing system usually comprises sulphur or a sulphur donor, at least one accelerator and at least one activator. Accelerators commonly used in the art may be selected from: dithiocarbamates, guanidine, thiourea, thiazoles, sulphenamides, thiurams, amines, xanthates, or mixtures thereof. Activators that are particularly effective are zinc compounds, such as ZnO, $ZnCO_3$, zinc salts of saturated or unsaturated fatty acids containing from 8 to 18 carbon atoms (e.g. zinc stearate), and also BiO, PbO, $Pb_3O_4$, $PbO_2$, or mixtures thereof.

Other components that may be included in the semiconductive polymeric compositions according to the present invention are: antioxidants, anti-ageing agents, plasticizers, lubricants, flame-retardants.

BRIEF DESCRIPTION OF THE DRAWINGS

Further characteristics will be apparent from the detailed description given hereinafter with reference to the accompanying drawings, in which.

The above figures show only preferred embodiments of the invention. Suitable modifications can be made to these embodiments according to specific technical needs and application requirements without departing from the scope of the invention.

DETAILED DESCRIPTION OF THE PREFERRED EMBODIMENTS

Figure 1:
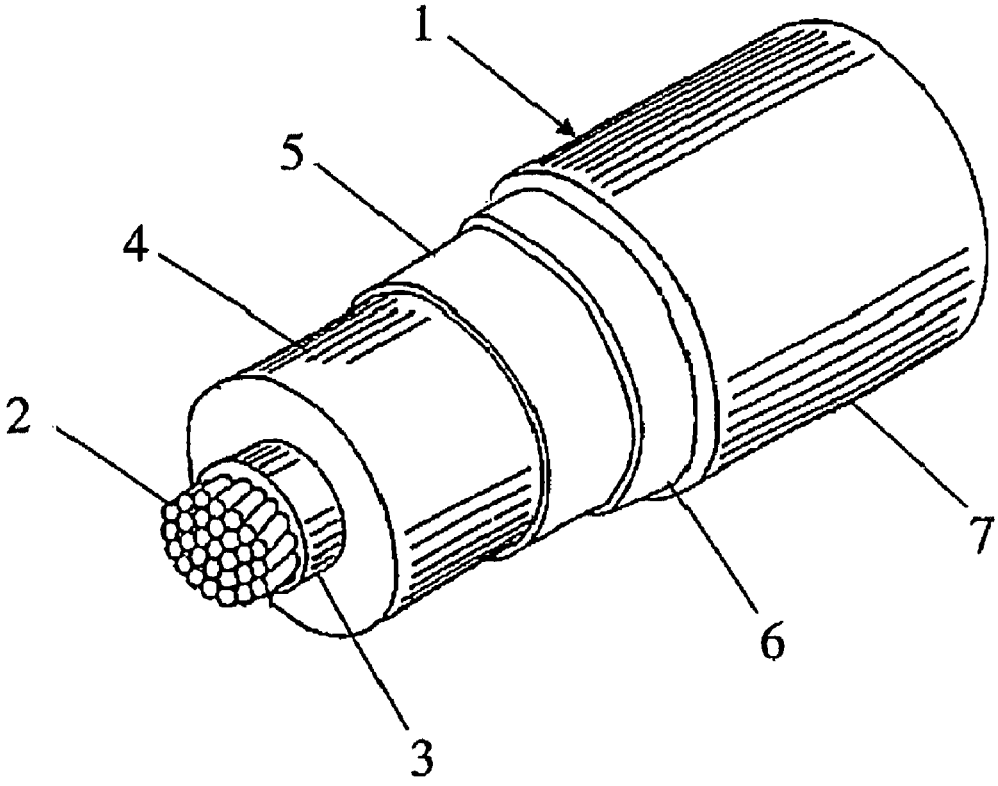
FIG. 1 is a perspective view of an energy cable, particularly suitable for medium or high voltage, according to the invention.

In FIG. 1, the cable (1) comprises a conductor (2), an inner layer with semiconductive properties (3), an intermediate layer with insulating properties (4), an outer layer with semiconductive properties (5), a metal screen layer (6), and a sheath (7).

The conductor (2) generally consists of metal wires, preferably of copper or aluminium or alloys thereof, stranded together by conventional methods, or of a solid aluminium or copper rod.

The insulating layer (4) may be produced by extrusion of a polymeric material around the conductor (2). The polymeric material is generally based on: polyolefins such as: polyethylene (PE), particularly low density polyethylene (LDPE), linear low density polyethylene (LLDPE), medium density polyethylene (MDPE), high density polyethylene (HDPE); polypropylene (PP); thermoplastic propylene/ethylene copolymers; ethylene-propylene rubbers (EPR); ethylene-propylene-diene rubbers (EPDM); ethylene/unsaturated ester copolymers such as: ethylene/vinyl acetate copolymer (EVA), ethylene/methyl acrylate copolymer (EMA), ethylene/ethyl acrylate copolymer (EEA), ethylene/butyl acrylate copolymer (EBA); or mixtures thereof.

At least one of the semiconductive layers (3) and (5) is made by extruding a semiconductive polymeric composition according to the present invention.

Around the outer semiconductive layer (5), a metal screen layer (6) is usually positioned, generally made of electrically conducting wires or strips helically wound around the cable core. The electrically conducting material of said wires or strips is usually copper or aluminium or alloys thereof. This screen layer (6) is then covered by a sheath (7), usually applied by extrusion of a polymeric material, such as polyethylene or polyvinylchloride.

The cable can be also provided with a protective structure (not shown in FIG. 1) the main purpose of which is to mechanically protect the cable against impacts or compressions. This protective structure may be, for example, a metal reinforcement or a layer of expanded polymer as described in WO 98/52197 in the name of the Applicant.

The cable according to the present invention may be manufactured in accordance with known methods, for example by extrusion of the various layers around the central conductor. The extrusion of two or more layers is advantageously carried out in a single pass, for example by the tandem method in which individual extruders are arranged in series, or by co-extrusion with a multiple extrusion head. When required, after the extrusion step the cable core is cross-linked according to well known techniques. The screen layer is then applied around the so produced cable core. Finally, the sheath according to the present invention is applied, usually by a further extrusion step.

Figure 2:
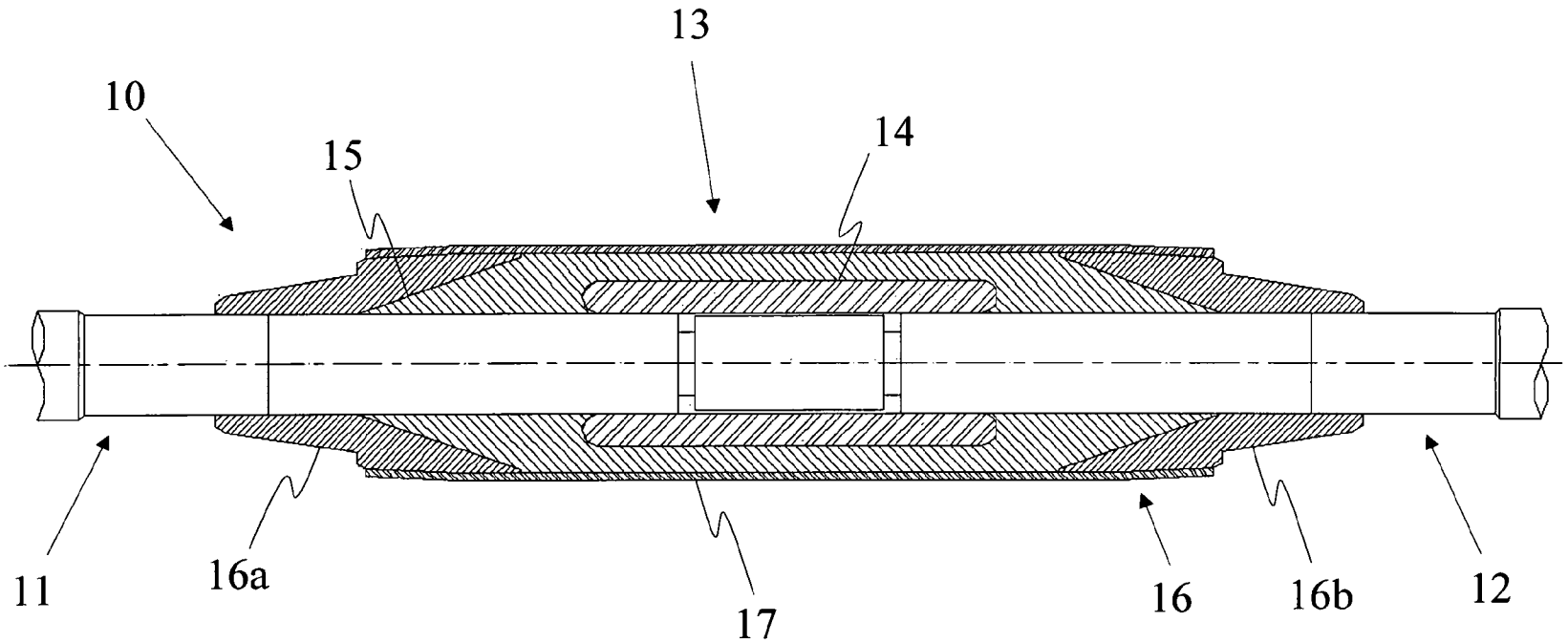
FIG. 2 is a side view of an axial section of an electric cable joint connecting two electric cables, according to the invention.

FIG. 2 is a side view of an axial section of a joint connecting two electric cables, according to a possible embodiment of the invention.

In FIG. 2, reference number (10) indicates the joint as a whole which connects a pair of cables (11, 12) of the single-core type.

The joining zone is covered by an elastomeric sleeve (13) which is slidably fitted onto one end of one of the cables (11, 12) before they are connected together and successively positioned above said joining zone once the electric connection of the cable conductors has been carried out.

The sleeve (13) comprises a semiconductive electrode (14) which is positioned in correspondence of the joining zone. The sleeve (13) further comprises an insulating element (15) into which said electrode (14) is embedded. The sleeve (13) further comprises a semiconductive element (16) which comprises two cup-shaped stress control screens (16*a*, 16*b*) and an insulation screen (17). The cup-shaped stress control screens (16*a*, 16*b*) have semiconductive properties and have the function of conveying the electric field. The insulation screen (17), which has also semiconductive properties, electrically connects the stress control screens (16*a*, 16*b*) so as to restore in the joining zone the continuity of the semiconductive layers of the cables (11, 12).

According to the present invention, at least one of the semiconductive elements described above, namely the electrode (14), the semiconductive element (16) comprising the two cup-shaped stress control screens (16*a*, 16*b*), the insulation screen (17), may be made from a semiconductive polymeric composition according to the present invention.

The following working examples are given to better illustrate the invention, but without limiting it.

EXAMPLES 1-5

The following compositions were prepared using a chlorinated polyethylene (CPE) as elastomeric polymer. In the compositions reported in Table 1 the amounts of the various components are expressed as phr, for the components of the filler mixture the percentages by weight with respect to the total weight of the filler mixture are also reported.

The compositions were prepared by using an internal Banbury mixer where all of the ingredients were added at the beginning, with the exception of the peroxide, which was added after discharging in an open mill mixer. At the end of the mixing process, curing was effected by an electric press (15 min at 180° C. and 200 bar) to provide sample plates of 1.0 mm thickness.

TABLE 1

| EXAMPLE | 1 (*) | 2 | 3 | 4 | 5 |
|---|---|---|---|---|---|
| Tyrin ™ CM 3551 E | 100 | 100 | 100 | 100 | 100 |
| Ketjenblack ™ EC-300J | 32.0 (33.3%) | 32.0 (37.2%) | 32.0 (57.1%) | 32.0 (37.2%) | 32.0 (57.1%) |
| N 550 | 64.0 (66.7%) | 54.0 (62.8%) | 24.0 (42.9%) | 54.0 (62.8%) | 24.0 (42.9%) |
| Timrex ™ KS-25 | — | 10.0 | 40.0 | — | — |
| Timrex ™ KS-44 | — | — | — | 10.0 | 40.0 |
| Stearic acid | 5.0 | 5.0 | 5.0 | 5.0 | 5.0 |
| DIDP | 40.0 | 40.0 | 40.0 | 40.0 | 40.0 |
| TMQ | 2.5 | 2.5 | 2.5 | 2.5 | 2.5 |
| Sandoflam ™ Sb-90 | 5.0 | 5.0 | 5.0 | 5.0 | 5.0 |
| Rhenogran ™ TAC/S | 5.0 | 5.0 | 5.0 | 5.0 | 5.0 |
| Luperox ™ F 40 MF | 6.8 | 6.8 | 6.8 | 6.8 | 6.8 |

(*) comparative

Tyrin ™ CM 3551 E (Dow Chem. Co.): chlorinated polyethylene in powder form, having: Mooney viscosity ML (1 + 4) @ 121° C. = 90, density (g/cm$^3$) = 1.16;

Ketjenblack ™ EC-300J (Akzo Nobel). carbon black having: DBF absorption number = 360 ml/100 g; BET surface area = 795 m$^2$/g;

N550 (Konimpex Ltd.): carbon black having: DBP absorption number = 121 ml/100 g; BET surface area = 40 m$^2$/g;

Timrex ™ KS-25 (Timcal Ltd.): crystalline graphite having BET surface area = 12 m$^2$/g; d50 = 11.0 μm; d90 = 27.2 μm;

Timrex ™ KS-44 (Timcal Ltd.): crystalline graphite having BET surface area = 9 m$^2$/g; d50 = 18.6 μm; d90 = 45.4 μm;

DIDP: diisododecylphthalate (plasticizer);

TMQ: staining antioxidant (quinoline derivative);

Sandoflam ™ Sb-90: antimony pentaoxide (10% w) pre-dispersed in wax (90% w)

Rhenogran ™ TAC/S: triallyl-cyanurate (70% w) pre-dispersed in silica (30% w)

Luperox ™ F 40 MF: bis-peroxide (40% w) pre-dispersed in an EVA-EPR blend (60% w).

The so obtained compositions were tested as follows:
Mooney viscosity (ASTM D 1646-92)
volume resistivity (UNI EN ISO 3915)
mechanical properties (CEI 20-34/1-1 ast. 9.1)
The results are reported in Table 2.

TABLE 2

| EXAMPLE | 1 (*) | 2 | 3 | 4 | 5 |
|---|---|---|---|---|---|
| Mooney Viscosity ML(1 + 4) @ 100° C. | >200 | 125.3 | 102.3 | 132.8 | 104.8 |
| Volume resistivity (Ohm · m) | 4.7 | 3.7 | 12.7 | 7.5 | 5.3 |
| Tensile strength (MPa) | 11.1 | 10.8 | 13.9 | 11.9 | 13.2 |
| Elongation at break (%) | 407.0 | 458.3 | 366.1 | 328.4 | 382.6 |
| Modulus at 50% (MPa) | 2.3 | 2.1 | 4.2 | 3.0 | 3.8 |

(*) comparative

The presence of graphite provides a substantial improvement (reduction) in the viscosity of the composition and in the workability thereof, without significantly affecting the mechanical properties. The volume resistivity is not appreciably altered.

EXAMPLES 6-10

Following the same procedures of Examples 1-5, the following compositions were prepared using an acrilonitrile/1,3-butadiene rubber (NBR) as elastomeric polymer. In the compositions reported in Table 3 the amounts of the various components are expressed as phr, for the components of the filler mixture the percentages by weight with respect to the total weight of the filler mixture are also reported.

TABLE 3

| EXAMPLE | 6 (*) | 7 | 8 | 9 | 10 |
|---|---|---|---|---|---|
| Krynac ™ 3345 C | 100 | 100 | 100 | 100 | 100 |
| Ketjenblack ™ EC-300J | 32.0 (30.4%) | 32.0 (48.9%) | 48.0 (59.0%) | 32.0 (48.9%) | 48.0 (59.0%) |
| N 550 | 73.4 (69.6%) | 33.4 (51.1%) | 33.4 (41.0%) | 33.4 (51.1%) | 33.4 (41.0%) |
| Timrex ™ LG-44 | — | 40.0 | 40.0 | — | — |
| Timrex ™ KS-44 | — | — | — | 40.0 | 40.0 |
| Zinc oxide S.V. | 4.9 | 4.9 | 4.9 | 4.9 | 4.9 |
| Lubricating agents | 9.4 | 9.4 | 9.4 | 9.4 | 9.4 |
| TMQ | 2.2 | 2.2 | 2.2 | 2.2 | 2.2 |
| DIDP | 51.1 | 51.1 | 51.1 | 51.1 | 51.1 |
| Luperox ™ F 40 MF | 3.1 | 3.1 | 3.1 | 3.1 | 3.1 |

(*) comparative

Krynac ™ 3345C (Lanxess): acrilonitrile/1,3-butadiene copolymer rubber having: Mooney viscosity ML (1 + 4) @ 100° C. = 46, specific gravity (g/cm$^3$) = 0.98, acrylonitrile content = 32.7% wt;
Ketjenblack ™ EC-300J (Akzo Nobel): carbon black having: DBP absorption number = 360 ml/100 g; BET surface area = 795 m$^2$/g;
N550 (Konimpex Ltd.): carbon black having: DBP absorption number = 121 ml/100 g; BET surface area = 40 m$^2$/g;
Timrex ™ LG-44 (Timcal Ltd.): natural graphite having BET surface area <6 m$^2$/g; d50 = 18.0 μm; d90 = 40.0 μm;
Timrex ™ KS-44 (Timcal Ltd.): crystalline graphite having BET surface area = 9 m$^2$/g; d50 = 18.6 μm; d90 = 45.4 μm;
TMQ: staining antioxidant (quinoline derivative)
DIDP: diisododecylphthalate (plasticizer)
Luperox ™ F 40 MF bis-peroxide (40% w) pre-dispersed in an EVA-EPR blend (60% w).

The so obtained compositions were tested according to the same procedures reported for Examples 1-5. The results are reported in Table 4.

TABLE 4

| EXAMPLE | 6 (*) | 7 | 8 | 9 | 10 |
|---|---|---|---|---|---|
| Mooney Viscosity ML(1 + 4) @ 100° C. | 81.6 | 40.8 | 79.9 | 45.7 | 88.1 |
| Volume resistivity (Ohm · m) | 0.486 | 0.258 | 0.073 | 0.292 | 0.042 |
| Tensile strength (MPa) | 11.5 | 9.6 | 8.1 | 8.6 | 9.7 |
| Elongation at break (%) | 237 | 315 | 239 | 305 | 257 |
| Modulus at 50% (MPa) | 2.3 | 3.1 | 3.4 | 2.2 | 3.4 |

(*) comparative

The capacity of graphite to improving (decreasing) the viscosity (see, e.g., Example 7 versus Example 6) allows to increase the amount of the first carbon black (Example 8) with a significant increase of conductivity (i.e. decrease of resistivity) without impairing the viscosity of the composition (see, e.g., Example 8 versus Example 6)

EXAMPLES 11-14

Following the same procedures of Examples 1-10, the following compositions were prepared using the same NBR of Examples 6-10 as elastomeric polymer. In the compositions reported in Table 5 the amounts of the various components are expressed as phr, for the components of the filler mixture the percentages by weight with respect to the total weight of the filler mixture are also reported.

TABLE 5

| | EXAMPLE | | | |
|---|---|---|---|---|
| | 11 (*) | 12 | 13 | 14 |
| Krynac ™ 3345 C | 100 | 100 | 100 | 100 |
| Ketjenblack ™ EC-300J | 32.0 (30.4%) | 32.0 (30.4%) | 32.0 (30.4%) | 32.0 (30.4%) |
| N550 | 73.4 (69.6%) | 73.4 (69.6%) | 73.4 (69.6%) | 73.4 (69.6%) |
| Timrex ™ LG-44 | — | 1.0 | 2.0 | 8.0 |
| Zinc oxide S.V. | 4.9 | 4.9 | 4.9 | 4.9 |
| Lubricating agents | 9.4 | 9.4 | 9.4 | 9.4 |
| TMQ | 2.2 | 2.2 | 2.2 | 2.2 |
| DIDP | 51.1 | 51.1 | 51.1 | 51.1 |
| Luperox ™ F 40 MF | 3.1 | 3.1 | 3.1 | 3.1 |

(*) comparative

Krynac ™ 3345 C (Lanxess): acrilonitrile/1,3-butadiene copolymer rubber, having: Mooney viscosity ML (1 + 4) @ 100° C. = 46, specific gravity (g/cm$^3$) = 0.98, acrylonitrile content = 32.7% wt;

Ketjenblack ™ EC-300J (Akzo Nobel): carbon black having: DBP absorption number = 360 ml/100 g; BET surface area = 795 m$^2$/g;

N550 (Konimpex Ltd.): carbon black having: DBP absorption number = 121 ml/100 g; BET surface area = 40 m$^2$/g Timrex ™ LG-44 (Timcal Ltd.): natural graphite having BET surface area <6 m$^2$/g; d50 = 18.0 μm; d90 = 40.0 μm;

TMQ: staining antioxidant (quinoline derivative);

DIDP: diisododecylphthalate (plasticizer);

Luperox ™ F 40 MF bis-peroxide (40% w) pre-dispersed in an EVA-EPR blend (60% w).

The so obtained compositions were tested according to the same procedures reported for Examples 1-5. The results are reported in Table 6.

TABLE 6

| | EXAMPLE | | | |
|---|---|---|---|---|
| | 11 (*) | 12 | 13 | 14 |
| Mooney Viscosity ML(1 + 4) @ 100° C. | 82.6 | 73.5 | 73.9 | 71.7 |
| Volume resistivity (Ohm · m) | 0.18 | 0.13 | 0.11 | 0.09 |
| Tensile strength (MPa) | 8.1 | 7.9 | 7.8 | 7.7 |
| Elongation at break (%) | 174.5 | 180.3 | 171.6 | 166.3 |
| Modulus at 50% (MPa) | 2.2 | 2.1 | 2.2 | 2.6 |

(*) comparative

The addition of graphite positively affected the viscosity of the composition improving the workability thereof even in low amounts. A slight decrease of resistivity was noticed probably due to the better admixability of the conductive carbon black.

EXAMPLES 15-18

Following the same procedures of Examples 1-10, the following compositions were prepared using the same NBR of Examples 6-10 as elastomeric polymer. In the compositions reported in Table 7 the amounts of the various components are expressed as phr, for the components of the filler mixture the percentages by weight with respect to the total weight of the filler mixture are also reported.

TABLE 7

| | EXAMPLE | | | |
|---|---|---|---|---|
| | 15 (*) | 16 | 17 | 18 |
| Krynac ™ 3345 C | 100 | 100 | 100 | 100 |
| Ketjenblack ™ EC-300J | 32.0 (30.4%) | 32.0 (30.9%) | 32.0 (31.6%) | 32.0 (32.9%) |

TABLE 7-continued

| | EXAMPLE | | | |
|---|---|---|---|---|
| | 15 (*) | 16 | 17 | 18 |
| N550 | 73.4 (69.6%) | 71.4 (69.1%) | 69.4 (68.4%) | 65.4 (67.1%) |
| Timrex ™ LG-44 | — | 2.0 | 4.0 | 8.0 |
| Zinc oxide S.V. | 4.9 | 4.9 | 4.9 | 4.9 |
| Lubricating agents | 9.4 | 9.4 | 9.4 | 9.4 |
| TMQ | 2.2 | 2.2 | 2.2 | 2.2 |
| DIDP | 51.1 | 51.1 | 51.1 | 51.1 |
| Luperox ™ F 40 MF | 3.1 | 3.1 | 3.1 | 3.1 |

(*) comparative

Krynac ™ 3345 C (Lanxess): acrilonitrile/1,3-butadiene copolymer rubber, having: Mooney viscosity ML (1 + 4) @ 100° C. = 46, specific gravity (g/cm$^3$) = 0.98, acrylonitrile content = 32.7% wt;

Ketjenblack ™ EC-300J (Akzo Nobel): carbon black having: DBP absorption number = 360 ml/100 g; BET surface area = 795 m$^2$/g;

N550 (Konimpex Ltd.): carbon black having: DBP absorption number = 121 ml/100 g; BET surface area = 40 m$^2$/g Timrex ™ LG-44 (Timcal Ltd.): natural graphite having BET surface area <6 m$^2$/g; d50 = 18.0 μm; d90 = 40.0 μm;

TMQ: staining antioxidant (quinoline derivative);

DIDP: diisododecylphthalate (plasticizer);

Luperox ™ F 40 MF bis-peroxide (40% w) pre-dispersed in an EVA-EPR blend (60% w).

The so obtained compositions were tested according to the same procedures reported for Examples 1-5. The results are reported in Table 8.

TABLE 8

| | EXAMPLE | | | |
|---|---|---|---|---|
| | 15 (*) | 16 | 17 | 18 |
| Mooney Viscosity ML(1 + 4) @ 100° C. | 82.6 | 75.8 | 73.8 | 67.2 |
| Volume resistivity (Ohm · m) | 0.18 | 0.09 | 0.12 | 0.08 |
| Tensile strength (MPa) | 8.1 | 8.2 | 8.2 | 8.5 |
| Elongation at break (%) | 174.5 | 170.6 | 180.6 | 183.9 |
| Modulus at 50% (MPa) | 2.2 | 2.3 | 2.2 | 2.4 |

(*) comparative

The addition of graphite positively affects the viscosity of the composition improving the workability thereof even in low amounts. A slight improvement of conductivity was noticed in spite of the reduction of N550, probably due to a better admixability of the latter.

EXAMPLES 19-21

In order to show the effectiveness of the compositions of the invention with respect to alternative technologies, compositions were made using an organic plasticizer in place of the graphite.

Following the same procedures of Examples 1-10, the following compositions were prepared using an NBR analogous to that of Examples 6-10 as elastomeric polymer, added with a commercial chloroparaffin as plasticizing agent. In the compositions reported in Table 9 the amounts of the various components are expressed as phr, for the components of the filler mixture the percentages by weight with respect to the total weight of the filler mixture are also reported.

TABLE 9

| | EXAMPLE | | |
|---|---|---|---|
| | 19 (*) | 20 (*) | 21 (*) |
| Krynac ™ 3450 | 100 | 100 | 100 |
| Ketjenblack ™ EC-300J | 32.0 (30.4%) | 32.0 (30.4%) | 32.0 (30.4%) |
| N 550 | 73.4 (69.6%) | 73.4 (69.6%) | 73.4 (69.6%) |
| Sandoflam ™ Sb-90 | 5.0 | 5.0 | 5.0 |
| Zinc oxide S.V. | 4.9 | 4.9 | 4.9 |
| Lubricating agents | 9.4 | 9.4 | 9.4 |
| TMQ | 2.2 | 2.2 | 2.2 |
| DIDP | 51.1 | 51.1 | 51.1 |
| Cloparin ™ 50 | — | 12.0 | 20.0 |
| Luperox ™ F 40 MF | 3.1 | 3.1 | 3.1 |

(*) comparative

Krynac ™ 3450 (Lanxess): acrilonitrile/1,3-butadiene copolymer rubber, having: Mooney viscosity ML (1 + 4) @ 100° C. = 50, specific gravity (g/cm$^3$) = 0.98, acrylonitrile content = 34.0% wt;

Ketjenblack ™ EC-300J (Akzo NobeJ). carbon black having: DBP absorption number = 360 ml/100 g; BET surface area = 795 m$^2$/g;

N550 (Konimpex Ltd.): carbon black having: DBP absorption number = 121 ml/100 g; BET surface area = 40 m$^2$/g Sandoflam ™ Sb-90: antimony pentaoxide (10% w) pre-dispersed in wax (90% w) - TMQ: staining antioxidant (quinoline derivative);

DIDP: diisododecylphthalate (plasticizer);

Cloparin ™ 50: chloroparaffin;

Luperox ™ F 40 MF: bis-peroxide (40% w) pre-dispersed in an EVA-EPR blend (60% w).

The so obtained compositions were tested according to the same procedures reported for Examples 1-5. The results are reported in Table 10.

TABLE 10

| | EXAMPLE | | |
|---|---|---|---|
| | 19 (*) | 20 (*) | 21 (*) |
| Mooney Viscosity ML(1 + 4) @ 100° C. | 68.6 | 69.3 | 68.7 |
| Volume resistivity (Ohm · m) | 0.13 | 0.25 | 0.21 |
| Tensile strength (MPa) | 10.8 | 10.8 | 11.1 |
| Elongation at break (%) | 238 | 251 | 271 |
| Tensile strength (MPa) after ageing | 12.0 | 15.1 | 17.5 |
| Elongation at break (%) after ageing | 61 | 50 | 33 |

(*) comparative

The above results clearly show that the use of a common plasticizing agent, such as a chloroparaffin, does not afford the desired decrease of viscosity.

Although an increase of conductivity should be expected because of the polar characteristics of the chloroparaffin, such effect actually was not observed. In addition, the mechanical characteristics of the compositions after ageing of the samples in an oven at 120° C. for 240 hours dramatically dropped, probably due to loss of plasticizer.

The invention claimed is:

1. An electric article comprising at least one element made from a semiconductive polymeric material, wherein said at least one element is obtained by crosslinking a semiconductive polymeric composition comprising:

(a) at least one elastomeric polymer;

(b) a filler mixture comprising: (i) at least one first carbon black having a dibutyl phthalate absorption number of 250 to 600 ml/100 g; (ii) at least one second carbon black, different from the first carbon black, having a dibutyl phthalate absorption number of 80 to 250 ml/100 g; and (c) at least one graphite having a specific surface area, measured according to the BET method, not higher than 20 m$^2$/g.

2. The electric article according to claim 1, comprising an electric cable.

3. The electric article according to claim 1, comprising an electric cable joint.

4. The electric article according to claim 1, comprising an electric cable termination.

5. The electric article according to claim 1, wherein the semiconductive polymeric composition comprises 25 to 250 phr of the filler mixture.

6. The electric article according to claim 5, wherein the semiconductive polymeric composition comprises 60 to 150 phr of the filler mixture.

7. The electric article according to claim 1, wherein the filler mixture comprises: (i) 10 to 80% by weight of the at least one first carbon black; (ii) 20 to 90% by weight of the at least one second carbon black, the percentages by weight being expressed with respect to the total weight of the filler mixture.

8. The electric article according to claim 7, wherein the filler mixture comprises: (i) 25 to 70% by weight of the at least one first carbon black; (ii) 30 to 75% by weight of the at least one second carbon black, the percentages by weight being expressed with respect to the total weight of the filler mixture.

9. The electric article according to claim 1, wherein the semiconductive polymeric composition comprises 0.5 to 70 phr of the at least one graphite having a specific surface area not higher than 20 m$^2$/g.

10. The electric article according to claim 9, wherein the semiconductive polymeric composition comprises 2 to 40 phr of the at least one graphite having a specific surface area not higher than 20 m$^2$/g.

11. The electric article according to claim 1, wherein the at least one elastomeric polymer is selected from:

(i) diene elastomeric polymers having a glass transition temperature below 20° C.;

(ii) chlorinated or chlorosulphonated polyethylenes;

(iii) elastomeric copolymers of at least one mono-olefin with at least one olefinic comonomer or a derivative thereof;

(iv) polyester rubbers; and (v) polyurethane rubbers.

12. The electric article according to claim 11, wherein the diene elastomeric polymers (i) are obtained by polymerization of at least one conjugated diolefin, or at least one conjugated diolefin in admixture with at least one comonomer selected from monovinylarenes and/or polar comonomers in a amount of not more than 60% by weight.

13. The electric article according to claim 12, wherein the conjugated diolefin or a halogenated conjugated diolefin contains 4 to 12 carbon atoms.

14. The electric article according to claim 13, wherein the conjugated diolefin is selected from: 1,3-butadiene, isoprene, 2-chloro-1,3-butadiene, 2,3-dimethyl-1,3-butadiene, 1,3-pentadiene, 1,3-hexadiene, 3-butyl-1,3-octadiene, 2-phenyl-1,3-butadiene, or mixtures thereof.

15. The electric article according to claim 12, wherein the monovinylarenes contain 8 to 20 carbon atoms.

16. The electric article according to claim 15, wherein the monovinylarenes are selected from: styrene, 1-vinylnaphthalene, α-methylstyrene, 3-methylstyrene, 4-propylstyrene, 4-p-tolylstyrene, or mixtures thereof.

17. The electric article according to claim 12, wherein the polar comonomers are selected from: vinylpyridine, vinylquinoline, acrylic acid and alkylacrylic acid esters, nitriles or mixtures thereof.

18. The electric article according to claim 12, wherein the diene elastomeric polymers (i) are selected from: natural or synthetic cis-1,4-polyisoprene, 3,4-polyisoprene, polybutadine, polychloroprene, isoprene/isobutene copolymers, halogenated isoprene/isobutene copolymers, 1,3-butadiene/acrylonitrile copolymers styrene/1,3-butadiene copolymers, styrene/isoprene/1,3-butadiene copolymers, styrene/1,3-butadiene/acrylonitrile copolymers, or mixtures thereof.

19. The electric article according to claim 18, wherein the diene elastomeric polymer (i) is a 1,3-butadiene/acrylonitrile copolymer.

20. The electric article according to claim 11, wherein the chlorinated polyethylenes (ii) have a chlorine content of 25% to 45% by weight.

21. The electric article according to claim 11, wherein the chlorosulphonated polyethylenes (ii) have a chlorine content of 20% to 45% by weight and a sulphur content of 0.8 to 2% by weight.

22. The electric article according to claim 11, wherein the elastomeric copolymers (iii) are obtained by copolymerization of at least one mono-olefin containing from 3 to 12 carbon atoms with at least one olefinic comonomer or a derivative thereof.

23. The electric article according to claim 22, wherein the elastomeric copolymers (iii) are selected from: copolymers of ethylene with an α-olefin, copolymers of ethylene with an α-olefin and a diene; isobutene homopolymers or copolymers thereof with small amounts of a diene, or at least partially halogenated isobutene homopolymers or copolymers with small amounts of a diene.

24. The electric article according to claim 23, wherein the elastomeric copolymers (iii) are selected from: ethylene/propylene copolymers, ethylene/propylene/diene terpolymers, polyisobutene, butyl rubbers, halobutyl rubbers, or mixtures thereof.

25. The electric article according to claim 1, wherein the first carbon black (i) has a dibutyl phthalate absorption number of 300 to 500 ml/100 g.

26. The electric article according to claim 1, wherein the first carbon black (i) has a BET specific surface area greater than 500 $m^2/g$.

27. The electric article according to claim 26, wherein the first carbon black (i) has a BET specific surface area of 600 to 2,000 $m^2/g$.

28. The electric article according to claim 1, wherein the second carbon black (ii) has a dibutyl phthalate absorption number of 100 to 200 ml/100 g.

29. The electric article according to claim 1, wherein the second carbon black (ii) has a BET specific surface area of 20 to 400 $m^2/g$.

30. The electric article according to claim 29, wherein the second carbon black (ii) has a BET specific surface area of 30 to 200 $m^2/g$.

31. The electric article according to claim 1, wherein the at least one graphite has a BET specific surface area not higher than 15 $m^2/g$.

32. The electric article according to claim 1, wherein the at least one graphite has a particle size distribution with a d50 value of at least 3 μm.

33. The electric article according to claim 32, wherein the at least one graphite has a particle size distribution with a d50 value of 5 to 25 μm.

34. The electric article according to claim 1, wherein the at least one graphite has a particle size distribution with a d90 value of at least 10 μm.

35. The electric article according to claim 34, wherein the at least one graphite has a particle size distribution with a d50 value of from 15 to 50 μm.

36. The electric article according to claim 1, wherein the at least one elastomeric polymer is crosslinked by thermal decomposition of at least one radical initiator.

37. The electric article according to claim 36, wherein the at least one elastomeric polymer is crosslinked by thermal decomposition of at least one organic peroxide.

38. The electric article according to claim 36, wherein the at least one elastomeric polymer is crosslinked by thermal decomposition of at least one radical initiator in the presence of at least one cross-linking coagent.

39. The electric article according to claim 1, wherein the at least one elastomeric polymer is crosslinked by a sulphur-based vulcanizing system.

40. A semiconductive polymeric composition comprising:

(a) at least one elastomeric polymer;

(b) at least one filler mixture comprising: (i) at least one first carbon black having a dibutyl phthalate absorption number of 250 to 600 ml/100 g; (ii) at least one second carbon black, different from the first carbon black, having a dibutyl phthalate absorption number of 80 to 250 ml/100 g; and (c) at least one graphite having a specific surface area, measured according to the BET method, not higher than 20 $m^2/g$.

41. The semiconductive polymeric composition according to claim 40, wherein the semiconductive polymeric composition comprises 25 to 250 phr of the filler mixture; or wherein the filler mixture comprises: (i) 10 to 80% by weight of the at least one first carbon black; (ii) 20 to 90% by weight of the at least one second carbon black, the percentages by weight being expressed with respect to the total weight of the filler mixture; or wherein the semiconductive polymeric composition comprises 0.5 to 70 phr of the at least one graphite having a specific surface area not higher than 20 $m^2/g$; or wherein the at least one elastomeric polymer is selected from:

(i) diene elastomeric polymers having a glass transition temperature below 20° C.;

(ii) chlorinated or chlorosulphonated polyethylenes;

(iii) elastomeric copolymers of at least one mono-olefin with at least one olefinic comonomer or a derivative thereof;

(iv) polyester rubbers; and (v) polyurethane rubbers; or wherein the first carbon black (i) has a dibutyl phthalate absorption number of 300 to 500 ml/100 g; or wherein the first carbon black (i) has a BET specific surface area greater than 500 $m^2/g$; or wherein the second carbon black has a dibutyl phthalate absorption number of 100 to 200 ml/100 g; or wherein the second carbon black (ii) has a BET specific surface area of 20 to 400 $m^2/g$; or wherein the at least one graphite has a BET specific surface area not higher than 15 $m^2/g$; or wherein the at least one graphite has a particle size distribution with a d50 value of at least 3 μm; or wherein the at least one graphite has a particle size distribution with a d90 value of at least 10 μm; or wherein the at least one elastomeric polymer is crosslinked by thermal decomposition of at least one radical initiator; or wherein the at least one elastomeric polymer is crosslinked by a sulphur-based vulcanizing system.

* * * * *